US005133236A

United States Patent [19]

Dudley

[11] Patent Number: 5,133,236

[45] Date of Patent: Jul. 28, 1992

[54] TIRE CUTTING TOOL

[76] Inventor: Joseph E. Dudley, Rte. 4, Box 896, Georgetown, Tex. 78626

[21] Appl. No.: 677,290

[22] Filed: Mar. 29, 1991

[51] Int. Cl.[5] ..... B26D 1/30; B26D 5/12

[52] U.S. Cl. ..... 83/608; 83/609; 83/639.1; 83/928; 83/951

[58] Field of Search ..... 83/951, 928, 607, 609, 83/608, 639.1

[56] References Cited

U.S. PATENT DOCUMENTS

| | | | |
|---|---|---|---|
| 2,101,755 | 12/1937 | Rosenstone et al. | 83/607 X |
| 2,789,642 | 4/1957 | Schwork | 83/608 |
| 3,911,772 | 10/1975 | Kisielewski | 83/951 X |
| 3,931,935 | 1/1976 | Holman | 241/24 |
| 4,241,882 | 12/1980 | Baikoff | 241/236 |
| 4,338,839 | 8/1982 | Farrel, Sr. et al. | 83/951 X |
| 4,338,840 | 7/1982 | Farrel, Sr. et al. | 83/951 X |
| 4,519,135 | 5/1985 | LaBounty | 83/928 X |
| 4,543,719 | 10/1985 | Pardoe | 83/609 X |
| 4,614,308 | 9/1986 | Barclay | 241/154 |
| 4,734,983 | 4/1988 | Brick | 30/228 |
| 4,805,507 | 2/1989 | Schmidt et al. | 83/951 X |
| 5,042,345 | 10/1991 | Hawkins et al. | 83/639.1 |

FOREIGN PATENT DOCUMENTS

| | | | |
|---|---|---|---|
| 2939849 | 4/1981 | Fed. Rep. of Germany | 83/951 |

*Primary Examiner*—Frank T. Yost
*Assistant Examiner*—Kenneth Peterson
*Attorney, Agent, or Firm*—Joseph F. Long

[57] ABSTRACT

A tire cutting tool wherein a curved hardened cutter blade is hydraulically driven to cuttably engage a tire between the cutting face of the cutter blades and open faces of a cutter anvil with a beginning end of the cutter blade entering between the open faces and holding the cutter blade in one plane as the blade is forced through the tire.

2 Claims, 2 Drawing Sheets

TIRE CUTTING TOOL

BACKGROUND OF THE INVENTION

At present in United States tires to be disposed of in a landfill must be cut into a minimum of four segments. There is then a need for a tire cutting tool that will cut both large and small tires in a rapid and economical manner in four or more segments.

The subject invention is aimed at filling this need for a versatile economical tire cutting tool. Since there are many small shops handling used tires a cutting tool that is rugged, fast acting and portable is desirable. We accomplish this by mounting a hydraulic drive cylinder with about 3½" diameter to drive a curved single blade cutter to cuttably engage a tire between the cutter and an open faced anvil mounted vertically on about a 6" steel beam. A drive motor that may be electrical or gasoline driven and an oil pump capable of pumping oil to operate the hydraulic cylinder at up to 3,000 psi is also mounted on the steel beam.

In a preferred embodiment, one end of the beam is mounted between wheels in a manner similar to a normal two wheel trailer. The other end of the beam is equipped to connect with a trailer hitch on a vehicle.

The curved single blade cutter is pivotally connected at the base and between the two faces of the anvil, or cutter back up plates, adjacent to the mounting beam. The anvil may be about three foot tall and is mounted vertically at right angles to the steel beam or mounting frame. Metal braces are welded between the back portion of the anvil and the mounting beam. The cutter shape is essentially as shown in drawings herein and is connected with the hydraulic drive cylinder so that as the extensible drive rod retracts the cutter there will be ample space to allow a tire to be moved between the curved end of the cutter and the faces of the cutter anvil. In a preferred embodiment, rollers on each side of the cutter are positioned so that when the cutter is in a fully retracted position that the edge of the cutting face of the cutter is below the rollers allowing a tire to be moved into a cutting position on the rollers.

A 6 h.p. motor is used to drive the oil pump supplying the oil to activate the hydraulic drive cylinder. With the large drive motor and oil pump that will supply oil at 3,000 psi to the hydraulic cylinder the cutter may be moved rapidly.

After a tire is in the cutting position, the equipment operator manually operates a lever to operate a two valve to cause the hydraulic drive cylinder to either retract or to extend the extensible drive rod to force the drive blade through the tire. With equipment as described there is approximately 10,000 pounds of force available to activate the cutter blade but in practice approximately 1,200 psi on oil to the hydraulic cylinder cuts even the larger tires quite easily. It is important that the tips of the cutter blade enters between the faces of the anvil first as the cutter blades starts to compress the tire and thereby holds the tire in a cuttable position and holds the blade in one plane as pressure increases to cut the tire.

The equipment is designed to allow the operator to rapidly extend or retract the cutter blade by simple movement of a lever.

There are several machines or tools for cutting a tire in the prior art. All differ significantly from our invention.

We would consider U.S. Pat. No. 4,805,507 to be pertinent. In U.S. Pat. No. 4,805,507 to Schmidt et al, a tire cutting machine is described wherein a vertical blade is driven by a hydraulic ram into a dual faced vertical anvil. A cutter with a scalloped edge is used to aid in preventing the tire from riding up on the shear. In our invention we use a curved cutter blade to hold the tire in position as the cutter engages the tire and most importantly the curved tip enters an anvil with a single adjustable cutter face before the pressure to actually cut the tire is applied. The guidance by the cutter tip is necessary to hold a cutter blade closely enough in one plane and allows use of a thin sharpened blade to allow rapid cutting of tires with a simple machine. One operator with our machine may cut 150 tires in an hour.

SUMMARY OF THE INVENTION

In a preferred embodiment the rapid tire cutting tool comprises:

a) a steel beam mounted on wheels for moving behind a vehicle; the steel beam forming the main structure for mounting components of the tool and hereinafter called a mounting frame;

b) approximately a 6 H.P. motor driving an oil pump to supply oil to a 3½" hydraulic drive cylinder at up to 3,000 psi is mounted to a side of the mounting frame. The hydraulic drive cylinder is pivotally attached on one end on the mounting frame along with a manually operated lever that controls flow of oil to the cylinder;

c) a curved single cutter blade aligned with the steel mounting frame may be retracted or pushed forward by the hydraulic drive cylinder;

d) a cutter anvil with one adjustable cutting face and a support face with minimum clearance to allow the cutter to move freely between the faces is rigidly attached in a vertical position to the mounting frame. The base end of the curved cutter blade is pivotally attached to the mounting frame closely adjacent to the cutter anvil base;

e) cylindrical rollers are held in a frame and mounted to end at right angles to the mounting frame. These rollers are sized and spaced so that when the curved cutter blade is fully retracted that the cutting edge of the lower portion of the cutter blade is below the roller surface. In this way a tire may be placed on the rollers and easily manually positioned between the cutter anvil and the fully retracted curved single blade cutter. As the curved cutter blade is pushed forward to cuttably engage a tire placed in the tool the tip end of the cutter blade enters between the cutter face and support face of the anvil just as the cutter blade starts to compress the tire. In this way the cutter blade is held in one plane as the major cutting force is applied by the hydraulic drive cylinder.

The unit is built quite ruggedly to allow use of the 3½" diameter hydraulic drive cylinder in order to develop enough pressure to rapidly and easily cut through large truck tires. Normally about 1,200 psi an oil supplied to the hydraulic drive cylinder is sufficient to easily cut large tires.

DETAILED DESCRIPTION OF THE INVENTION

We may describe the invention most simply from the drawings.

Figure 1:
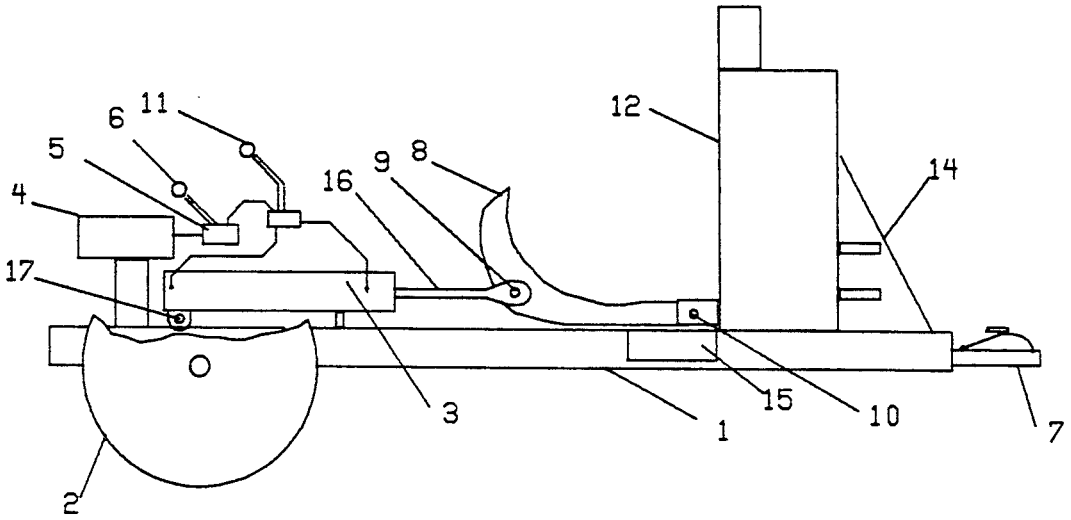
FIG. 1 shows a side view of an embodiment wherein the tool is portable.

In FIG. 1 we show a side view of the tool with mounting frame 1 which is about a 6" steel beam mounted on wheels 2 with ball joint trailer hitch 7. Cutter anvil 12 may be about three feet tall and is fabricated from ⅝" to ½" plate and welded with a brace 14 as shown to mounting frame 1. A single blade curved cutter 8 may be fabricated with a shape approximately as shown from hardenable steel plate or of an alloy of greater than 59 Rockwell hardness that is approximately ½" thick; a Rockwell hardness of 55-60 has been shown to give a long lasting cutting edge. The base of the cutter 8 is pivotally connected between the projecting base of anvil 12 with about a one inch diameter hardened pivot pin 10.

The curved cutter blade 8 is pivotally connected to a Y shaped end of extensible drive rod 16 with pivot pin 9 which may be about a ¾" hardened steel pin. The extensible drive rod 16 is driven by the hydraulic drive cylinder 3 which is pivotally connected to the mounting frame 1 with about a ¾" pivot pin.

Figure 2:
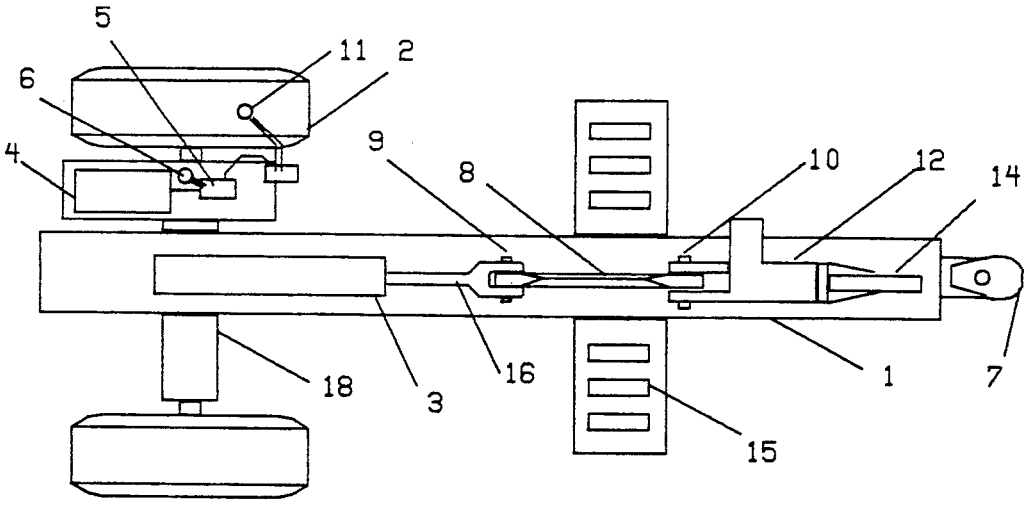
FIG. 2 shows a top view indicating relative positions of the components.

A hydraulic oil pump 5 driven by either an electric or gasoline motor 4 is mounted to cross member 18, FIG. 2, of frame 1 along with support for a lever activated two valve 11 to be manually operated to direct oil to the appropriate end of the hydraulic drive cylinder 3 to retract or force cutter 8 to cuttably engage a tire placed between cutter 8 and anvil 12. Oil pump 5 is equipped with pressure gauge 6 to monitor pressure necessary for operation of cutter 8. Feed rollers 15 to aid in positioning a tire are shown in FIG. 2 for sake of clarity of the drawing in FIG. 1.

In FIG. 2 we show a plan view. Mounting frame 1 which is a 6" steel beam has cross member 18 which is a similar sized beam with axles for wheels 2. The hydraulic pump drive motor 4 to drive oil pump 5 equipped with gauge 6 supplies oil under pressure through a two way lever activated valve 11 mounted on frame 18 with about ⅜" plate welded to frame 18. Operation of the lever activated valve 11 controls oil pressure to hydraulic drive cylinder 3 to retract or extend extensible rod 16 which is pivotally connected to cutter 8 with pivot pin 9. Feed rollers 15 aid in positioning a tire so that cutter 8 may cuttably engage tire against anvil 12.

Figure 3:
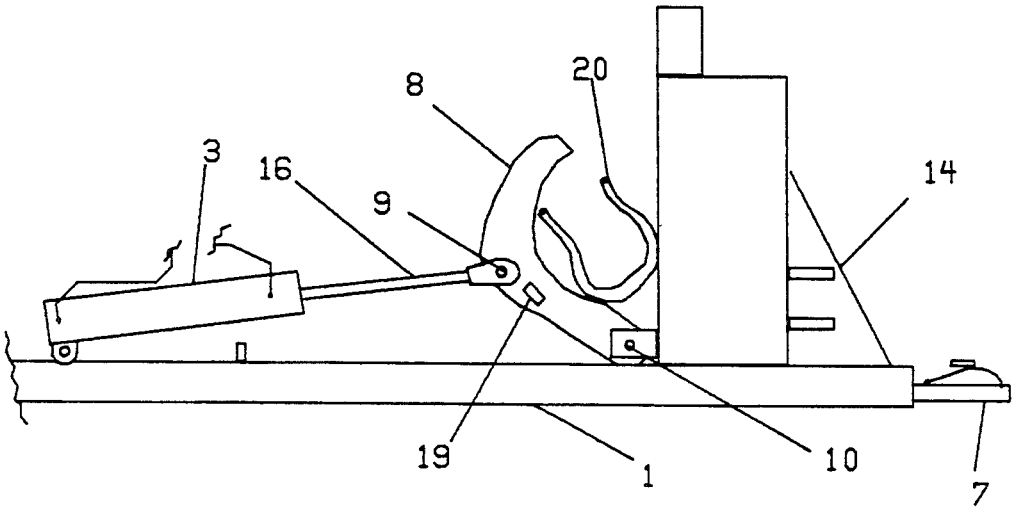
FIG. 3 shows approximate shape of the curved cutter blade and connections thereto.

In FIG. 3 we've shown a side view to give more detail of cutter 8. Cutter 8 in a preferred embodiment is fabricated from ½" thick steel plate with minimum Rockwell hardness of 55-60 and shaped approximately as shown. The base end or first end of cutter 8 is attached at the base of anvil 12 adjacent to mounting frame 1 with pin 10. As extensible rod 16 is driven forward by hydraulic drive cylinder 3, the point or beginning end of cutter 8 moves between the faces of anvil 12 to hold cutter 12 in one plane as greater force is applied to cut through tire 20. Stop plate 19 stops the cutter 8 against the anvil 12 if the operator neglects to stop the cutter by activating the lever activated 2 way valve 11. In a preferred embodiment this valve 11 is called a Detent Valve and is available from Spence Mfg., Sioux City, Iowa. This valve has an over pressure bypass which may be set at about 3,000 psi to limit the force applied to cutter 8.

Figure 4:
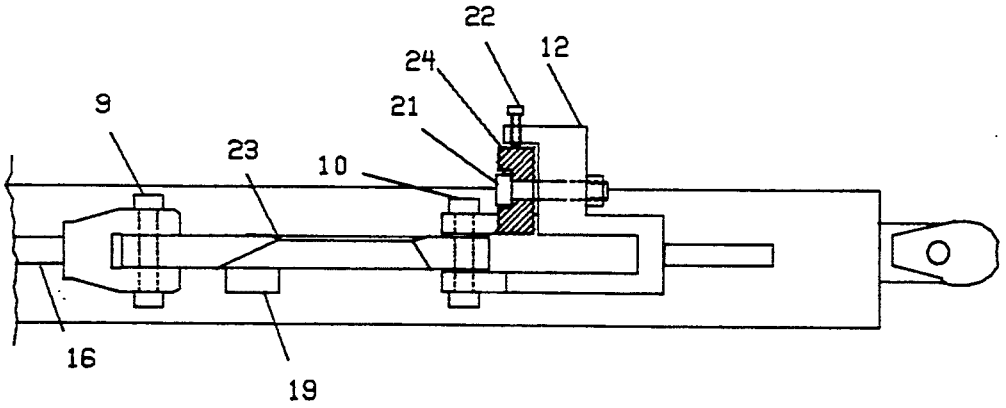
FIG. 4 shows a top view to indicate mounting of the adjustable cutter face of the anvil. Normally this would be of steel of greater than 60 Rockwell hardness.

In FIG. 4 we show a plan view of anvil 12 and cutter 8 to indicate sharpened leading edge of cutter 8 and an adjustable cutter face 24 which is one of the dual faces of anvil 12. Bolts 21 hold the cutter face 24 through slotted holes to anvil 12. The slotted holes allow adjustment of cutter face 24 with adjustment bolts 22. Cutter face 24 should have a Rockwell hardness of a minimum of 60. It is necessary for cutter blade 8 to fit closely but freely between faces of anvil 12. The very tip of cutter 8 does not cuttably engage the tire and is sharpened as shown at point 21 to act as a guide to prevent the sharpened leading edge of cutter 8 from striking the sharpened edge of cutter face 24 due to minor variations or wear in pivot pins 9 and 10.

Extensible rod 16 is connected to cutter 8 with pivot pin 9 going through both sides of a Y type connection. Stop plate 19 limits the travel of cutter 8. Normally the operator stops the travel of the cutter before hitting the stop plate 9 but an overpressure relief in the lever valve 11 limits oil pressure driving hydraulic drive cylinder 3 to prevent damage from over pressure against the anvil.

We have outlined in some detail one preferred embodiment of a rugged tool that will rapidly cut even large tires. Obviously many mechanical changes could be made by one of normal skill in the mechanical arts, we therefore do not wish to be limited to exact details but only as to general spirit and purpose as outlined in these claims and specifications.

What is claimed is:

1. A tire cutting tool comprising:

a) a single member metal mounting frame;

b) a pair of wheels mounted on an axle, said axle being mounted to a first end of said mounting frame;

c) a crescent shaped single blade cutter means, a cutter anvil mounted perpendicular to said mounting frame and having a straight cutting edge and support face and a hydraulic drive cylinder operably interconnected and mounted on said mounting frame; a rounded first end of said crescent shaped single blade cutter means being pivotally mounted adjacent to said cutting edge and said support face of said anvil and adjacent to said mounting frame; said single blade cutter further being pivotally connected at a mid point to said hydraulic drive cylinder;

d) a feed roller means mounted on both sides of said mounting frame to aid in manually positioning a tire between said cutter means and said cutter anvil;

e) an activator means to activate said hydraulic drive cylinder to drive said single blade cutter means to cut a tire placed between said anvil and said crescent shaped single blade cutter means by forcing said cutter means toward said anvil with a pointed second end of said cutter entering between said said cutting edge and said support face of said anvil before said cutter means cuttably engages a workpiece thereby holding said cutter means in one plane as said hydraulic drive cylinder forces said cutter means to cut through said tire as said cutter means travels between said cutting edge and said support face of said anvil; said tire cutting tool being constructed to be towed by a car.

2. A tire cutting tool comprising:

a) a mounting beam;

b) a straight cutter anvil with a straight support face and a straight cutting edge adjustably separated; said cutter anvil being mounted vertically to said mounting beam;

c) a single blade crescent shaped cutter means approximately ½ inch thick with a sharpened leading edge and with a rounded base end of said cutter means mounted adjacent to said support face and said straight cutting edge of said cutter anvil and adjacent to said mounting beam;

d) a hydraulic drive cylinder means with a first end hinge mounted to said mounting beam and with a Y shaped end of an extensible drive rod driven by said hydraulic drive cylinder means pivotally connected to said single blade crescent shaped cutter means whereby retracting said extensible drive rod of said hydraulic drive cylinder means moves said cutter means to allow placing a tire between said cutter means and said cutter anvil and extension of said extensible drive rod forces said cutter through said tire with a beginning end of said cutter entering into and between said straight support face and said straight cutting edge of said cutter anvil before cuttably engaging said tire.

* * * * *